US007073726B2

(12) United States Patent
Sharp et al.

(10) Patent No.: US 7,073,726 B2
(45) Date of Patent: Jul. 11, 2006

(54) BRIDGING PLATFORM ARRANGEMENT

(76) Inventors: Allan Sharp, 23 Connell Drive, Melton South, Victoria, 3338 (AU); Betty Lynette Sharp, 23 Connell Drive, Melton South, Victoria, 3338 (AU)

( * ) Notice: Subject to any disclaimer, the term of this patent is extended or adjusted under 35 U.S.C. 154(b) by 0 days.

(21) Appl. No.: 10/939,090

(22) Filed: Sep. 10, 2004

(65) Prior Publication Data

US 2005/0061894 A1 Mar. 24, 2005

Related U.S. Application Data

(63) Continuation-in-part of application No. PCT/AU03/00312, filed on Mar. 14, 2003.

(30) Foreign Application Priority Data

Mar. 15, 2002 (AU) ..... PS1212

(51) Int. Cl.
*E01B 1/00* (2006.01)
*E01B 21/00* (2006.01)

(52) U.S. Cl. ..... 238/8

(58) Field of Classification Search ..... 238/2, 238/3, 5, 8

See application file for complete search history.

(56) References Cited

U.S. PATENT DOCUMENTS 2,574,926 A * 11/1951 Manley ..... 238/8
2,950,057 A * 8/1960 Speer ..... 238/8
3,469,783 A * 9/1969 Bormann et al. ..... 238/8
2003/0168519 A1 * 9/2003 Hofstetter, Sr. ..... 238/8

FOREIGN PATENT DOCUMENTS

DE 28 12 550 A1 10/1978
DE 201 01 567 U1 5/2001

* cited by examiner

*Primary Examiner*—S. Joseph Morano
*Assistant Examiner*—Robert J. McCarry, Jr.
(74) *Attorney, Agent, or Firm*—William J. Sapone; Coleman Sudol Sapone P.C.

(57) ABSTRACT

The invention relates to a bridging platform arrangement (20) for bridging a gap (16) between a railway rail (10) and an adjacent ground surface (14). The bridging platform arrangement (20) includes a bridging plate (58) and a mounting arrangement for mounting the bridging plate (58) between the railway rail (10) and the ground surface (14). In use, the mounting arrangement permits displacement of the bridging plate (58) between two positions—a first rest position in which the bridging plate (58) extends between respective upper surfaces of the railway rail (10) and the ground surface (14); and a second displaced position in which the bridging plate (58) is displaced below the first position so as to not interfere with the passage along the railway rail (10) of a wheel (1) of a railway vehicle. The mounting arrangement is operable to permit displacement of the bridging plate (58) from the first position to the second position under a railway vehicle load and to substantially maintain the first position when the bridging plate is engaged by a load substantially less than that of the railway vehicle load.

18 Claims, 7 Drawing Sheets

BRIDGING PLATFORM ARRANGEMENT

CROSS REFERENCE TO RELATED APPLICATION

This application is a continuation in part of PCT international Patent application no. PCT/AU03/00312, filed Mar. 14, 2003.

FIELD OF THE INVENTION

The present invention relates to a bridging platform arrangement. In particular, the present invention provides an arrangement for locating adjacent a railway track. It will be convenient to describe the invention with reference to a railway rail application, but it should be understood that the invention may have wider application.

BACKGROUND OF THE INVENTION

A railway track is usually provided as a pair of elongate rails having a constant cross section. A train that travels over these rails usually has a pair of large diameter wheels connected by an axle wherein each wheel is located above each rail of the track. Each wheel usually sits on its respective rail so that a portion of the wheel overhangs the side of the rail providing a guiding means for each wheel on each respective rail. As the track curves in one direction, the overhang of one wheel on one rail will drag the train in the direction of the rail thus pulling the opposite wheel in a similar direction.

Most railway tracks will rest on a support bed such as a concrete base or alternatively timber bearers, and it is usual for gravel/stones to be located over the railway track area to protect the underlying bed surface and assist with drainage. However, when a railway track crosses a road or a pathway, it is usual for each rail to sit in a recess formed in the roadway/pathway. Because the wheels of the train overhang the sides of a rail, there is always a gap formed between the rail and the roadway/pathway surface material.

In the case of a roadway, this gap does not affect most users as most vehicles are able to traverse this gap without significant effects to their vehicle. However, in the case of a pathway, the gap formed between the rail and the pathway surface can cause problems for certain users, in particular, disabled or infirm persons. For example, a wheelchair usually has a set of main driving wheels together with a pair of much smaller support wheels. It is common for the small support wheels to become trapped in the gap formed between the rail and the pathway, especially when the user of the wheel chair is moving at a slow pace. If such a user is trapped in this gap and cannot get assistance readily, the user is liable to potential danger from an oncoming train. Similarly, a person who is on crutches can get the peg of the crutch caught in the gap which can also lead to further injury to the user by falling over. The crutch being caught in the gap can also cause problems for an oncoming train if it is left there.

It would be desirable to provide a solution that provides users of railway crossing pathways a safe mode of crossing a railway track without experiencing any of the problems mentioned above while still maintaining the performance requirements of the existing trains.

SUMMARY OF THE INVENTION

According to a broad aspect, the present invention provides a bridging platform arrangement for bridging a gap between a railway rail. and an adjacent ground surface including:

- a bridging plate;
- a mounting arrangement for mounting said bridging plate between said railway rail and said ground surface;
- wherein in use, said mounting arrangement permits displacement of said bridging plate between:
  - a first rest position in which said bridging plate extends between respective upper surfaces of said railway rail and said ground surface; and
  - a second displaced position in which said bridging plate is displaced below said first position in which said plate does not interfere with the passage along said railway rail of a wheel of a railway vehicle; said mounting arrangement being operable to permit displacement of said bridging plate from said first position to said second position under a railway vehicle load imposed on said bridging plate by engagement of said bridging plate by the wheel of a railway vehicle, and to substantially maintain said first position when said bridging plate is engaged by a load substantially less than that of said railway vehicle load.

The arrangement of the present invention advantageously provides that the load of a pedestrian or a wheelchair will not cause displacement of the bridging plate from the first position to the second position. In this manner, such users can cross a railway crossing more safely than prior art arrangements.

In at least one preferred embodiment, the bridging plate has an upper surface that is generally planar. Preferably, the bridging plate has an upper surface that is substantially flush with said ground surface and the upper surface of said railway rail.

Preferably, the bridging plate is elongate, having a width in a direction between the railway rail and the ground surface, and length in the direction parallel to the railway rail. In one embodiment, the width of the bridging plate extends substantially between the railway rail and the ground surface, and the length extends substantially along the railway rail and adjacent ground interface, such as the pavement of a pedestrian crossing.

In one preferred embodiment, the mounting arrangement includes a biasing means for permitting displacement of the bridging plate between said first and second positions. Preferably, the biasing means biases the bridging plate towards the first position. In one preferred embodiment, the biasing means is pre-loaded in said first position. Preferably, the biasing means is pre-loaded to between 120 kg and 250 kg. More preferably, the biasing means is pre-loaded to 190 kg. Preferably, the biasing means is a coil spring.

In one preferred embodiment, the mounting arrangement includes at least one piston connected to the biasing means at a first end, and to the bridging plate at the second end. It is preferred that the mounting arrangement includes a housing for housing the biasing means, wherein the housing includes a base and a top, and sidewalls extending therebetween, the biasing means located inside the housing, and said top including an opening through which said piston extends for connection with the biasing means. Preferably, the mounting arrangement includes a mounting arrangement includes a transfer plate movably positioned inside said housing for movement with said biasing means between said biasing means and said top of said housing, said piston being connected to said biasing means by connection to said transfer plate. It is preferred that the biasing means is pre-loaded in the housing to the first position. Preferably, said housing is positioned between adjacent sleepers that support the railway rail.

In one preferred embodiment, the mounting arrangement includes securing means for securing the mounting arrangement to the railway rail. It is preferred that the securing means includes a first connection element in connection with said housing, said first connection element being secured to a first side of the base of the railway rail adjacent the housing, and a second connection element in connection with said housing, said second connection element being secured to a second side of the base of the railway rail remote from the housing, the arrangement being such that by tightening of said second connection element relative to said housing, the housing is secured to said railway rail.

In at least one preferred embodiment, the mounting arrangement includes a guard frame, said guard frame being positioned between said bridging plate and said adjacent ground surface. It is preferred that the guard frame said guard frame extends along said length of said bridging plate, and extends along said width of the bridging plate and in connection with said railway rail at each end of said bridging plate.

Preferably, the mounting arrangement includes a flange extending from said top of said housing, said flange being located in use on the side of said housing remote the railway rail, wherein said flange connects said guard frame to said housing. Preferably, said flange is an extension of said sidewall of the housing. It is preferred that the mounting arrangement includes a spacer insertable between said guide frame and said flange to adjust the location in use of said guide frame relative to the railway rail. Preferably, the spacer is connected to the guide frame and the flange by welding, or alternatively, by bolted connection.

In at least one preferred embodiment, the guard frame is adapted for connection to the adjacent railway rail. Preferably, the guard frame is connected to the railway rail via a connection bolt through a web hole in the web of the railway rail into a frame hole in the guard frame.

In at least one preferred embodiment, the bridging platform arrangement includes at least two said mounting arrangements spaced along the length of said bridging plate.

In an alternate preferred embodiment the mounting arrangement includes a base which is locatable adjacent the railway rail. Preferably, the biasing means is coupled to the base and the bridging plate. In this preferred form, the mounting arrangement includes at least one pair of concentric sleeves, each sleeve having a length shorter than the distance between the base and the bridging plate in the second position, the first concentric sleeve being connected to the bridging plate and extending towards the base, and the second concentric sleeve being connected to the base and extending towards the bridging plate, each respective sleeve being co-axial and having a different sized cross-section so that the respective sleeves are aligned to move inside each other to allow for displacement of the bridging plate between the first and second positions.

In one preferred embodiment, the biasing means is positioned around one of the sleeves. Preferably, the upright member and the sleeve have a similar shaped cross section. More preferably, the cross-section of the sleeves is either circular or rectangular.

In at least one preferred embodiment, a guiding means is provided to assist with the movement of the bridging plate relative to the frame. In one preferred form, the guiding means provides guidance for the bridging plate in a direction between the first and second positions. In another preferred form, the guiding means provides guidance for the bridging plate in a direction along the railway rail. As the train approaches the bridging platform arrangement, any impact forces in the direction of the railway rail on the bridging platform arrangement can be controlled by the guiding means to assist the bridging platform arrangement from being damaged by these forces.

In at least one preferred embodiment, 2 or more bridging platform arrangements can be positioned adjacent a railway rail in the direction of the railway rail. Preferably, the bridging plate of a first bridging platform arrangement includes linking means for connection to the linking means of a second bridging platform arrangement, so as to link the two arrangements together. Preferably, the linking means includes a slot formed in the bridging plate, so that a coupling pin can link a first bridging platform arrangement with a second bridging platform arrangement. In this form, multiple bridging platform arrangements can be provided along a railway rail so that a wider pathway can be accommodated. As a train approaches, the first bridging platform arrangement can be displaced to the second position, with subsequent bridging platform arrangements acting similarly as the train passes over them. When the train has passed, the bridging platform arrangements can return back to their first position. A "snake" effect can be observed in this manner.

In an alternative embodiment, the mounting arrangement of a bridging platform arrangement according to the invention includes at least two deflectable members which are spaced apart between opposite ends of the bridging plate. The deflectable members can be deflected in the direction of movement of a railway wheel along the bridging plate to allow displacement of the bridging plate between the first and second positions. The deflectable members are arranged to return from a deflected position following complete travel of a railway wheel along the bridging plate so that the bridging plate can be returned to the first position.

In the preferred arrangement, each deflectable member is a coil spring which extends substantially vertically when the bridging platform is in the first position. Each coil spring preferably is fixed in place at the bottom end thereof and is connected at an upper end thereof to the bridging plate. The coil springs facilitate movement of the bridging plate between the first and second positions by deflecting upon imposition of a load applied by a railway wheel to either end of the bridging plate. Thus, the coil springs bend in the direction of travel of the railway wheel.

The deflectable members can be other than a coil spring and can, for example be a deflectable elongate metal, metal composite or a plastic or rubber material. A metal cantilever spring could be employed for example. Likewise, a spring biased member could be employed whereby the member deflects against the bias of the spring and is returned from deflection by that spring.

In a preferred arrangement, at least two pairs of adjacent deflectable members are spaced apart between the opposite ends of the bridging plate. In this arrangement, the adjacent deflectable members are spaced apart generally laterally to a line extending between the opposite ends of the bridging plate. In this preferred arrangement, the preference is that each of the deflectable members of each pair of adjacent deflectable members is a coil spring. The pairs of deflectable members could be replaced by groups of three or more deflectable members as required. The number of deflectable members may vary depending on the position along the length of the bridging plate.

If coil springs are employed, then the selection of material and spring constant is a matter within the skill of a person skilled in this art. Considerations will include loading, environment and fatigue life. Other considerations may also apply.

An advantage of a coil spring is that in the upright or vertical orientation, the coil spring can act as a column and thereby support significant vertical weight. Thus, the coil spring can be compacted in its upright orientation, so that the helical coils thereof are in contact, rather than in spaced relationship. This contact may occur under the weight of the bridging plate, or the coil spring may be formed to have that contact under no external load. The further advantage of the coil spring, is that it can readily be deflected as required by a force acting laterally to the axis of the spring. Thus, deflection can be initiated easily in either direction of travel of a railway wheel. Also, the coil springs will naturally recover to the upright position.

In a preferred arrangement, the bridging plate is an L-section comprising a downwardly extending flange and a web extending perpendicular to the flange. More preferably, the bridging plate is a C-section defining a centre web and a pair of parallel flanges which extend downwardly from the web. For either section, the bridging plate further includes a connection member disposed adjacent the downwardly extending flange of the L-section, or between the parallel flanges of the C-section, and connected to one or each of the flanges for rotation relative to the respective section. The connection between the connection member and the section is such as to facilitate relative rotation during movement of the bridging plate between the first and second positions. The connection may be made by a pin which extends through the connection member and through the or each of the flanges.

In the above embodiment of the invention, the bridging plate shifts parallel to the railway rail as it moves between the first and second positions. The movement can be arcuate depending on how the deflectable members deflect. Also, the bridging plate may remain horizontal lengthwise thereof as it moves between the first and second positions or it can move in a wave-like manner.

It will be convenient now to describe the above and further features and advantages of the present invention, which will be evident from the following detailed description of the preferred embodiment which can be read with reference to the accompanying drawings, in which:

DETAILED DESCRIPTION OF THE PREFERRED EMBODIMENTS

Figure 1:
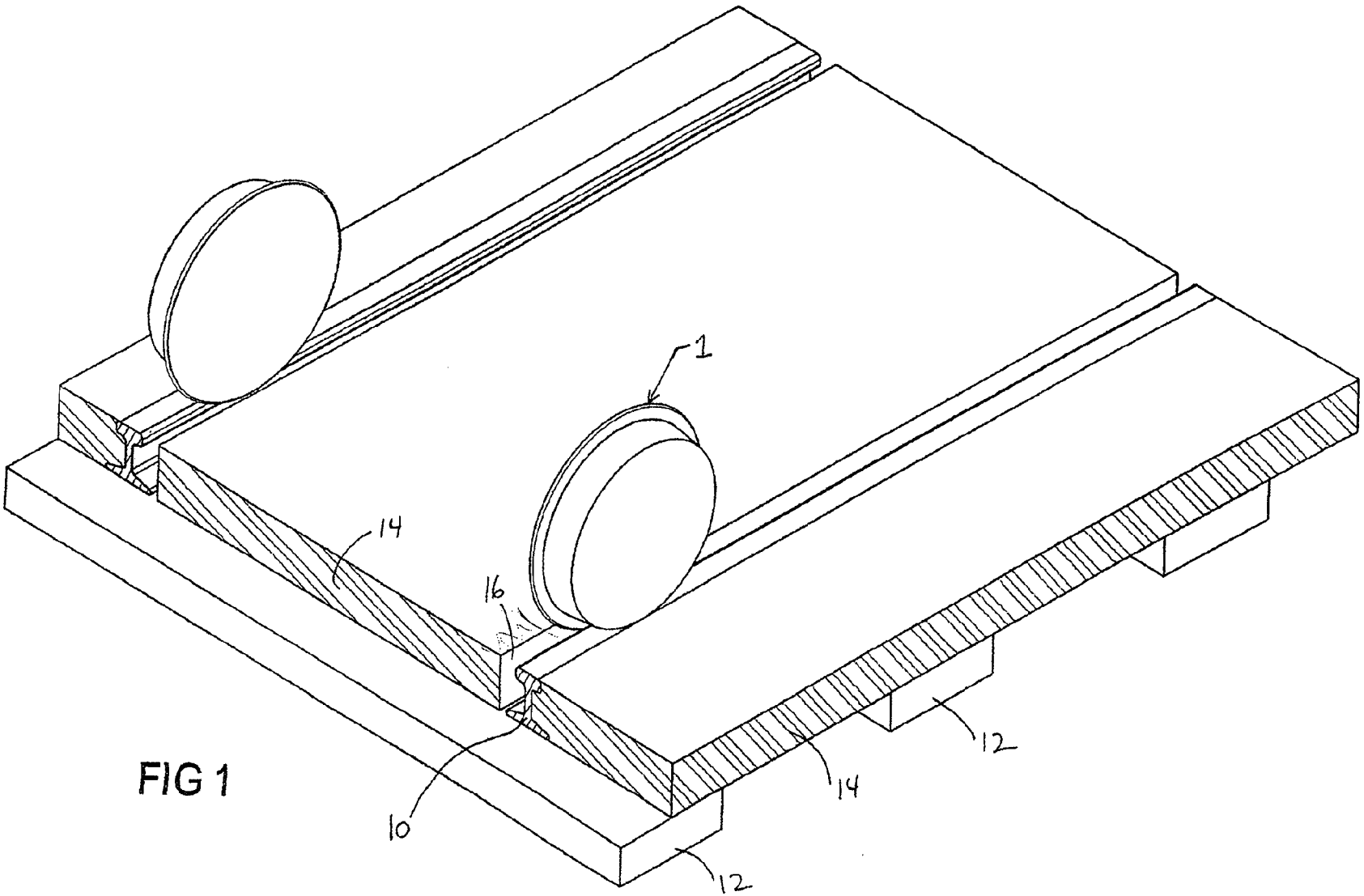
FIG. 1 is a perspective cross-sectional view of the prior art railway rail and pavement crossing.

FIG. 1 shows a perspective cross-sectional view of a prior art crossing illustrating a set of railway rails interfacing with a pavement. The railway vehicle (such as a train) is not shown in this drawing, however a pair of railway wheels 1 are represented. sitting upon the railway rail 10. Railway rails 10 sit upon a series of spaced apart sleepers 12. These sleepers 12 may be formed of timber or another material such as concrete, and it is usual for the railway rail 10 to be secured to sleeper 12 via connection pins (now shown). The sleepers 12 are placed of a sub-base of crushed rock 11 (not shown). In this drawing, a pavement matrix 14 is shown embedded between the railway rails 10 as representative of a typical pedestrian crossing. As can be seen, a gap 16 is formed between each railway rail 10 and the pavement 14 in order to permit the passage of the flange of the railway wheel 1 to pass over the rail.

Figure 2:
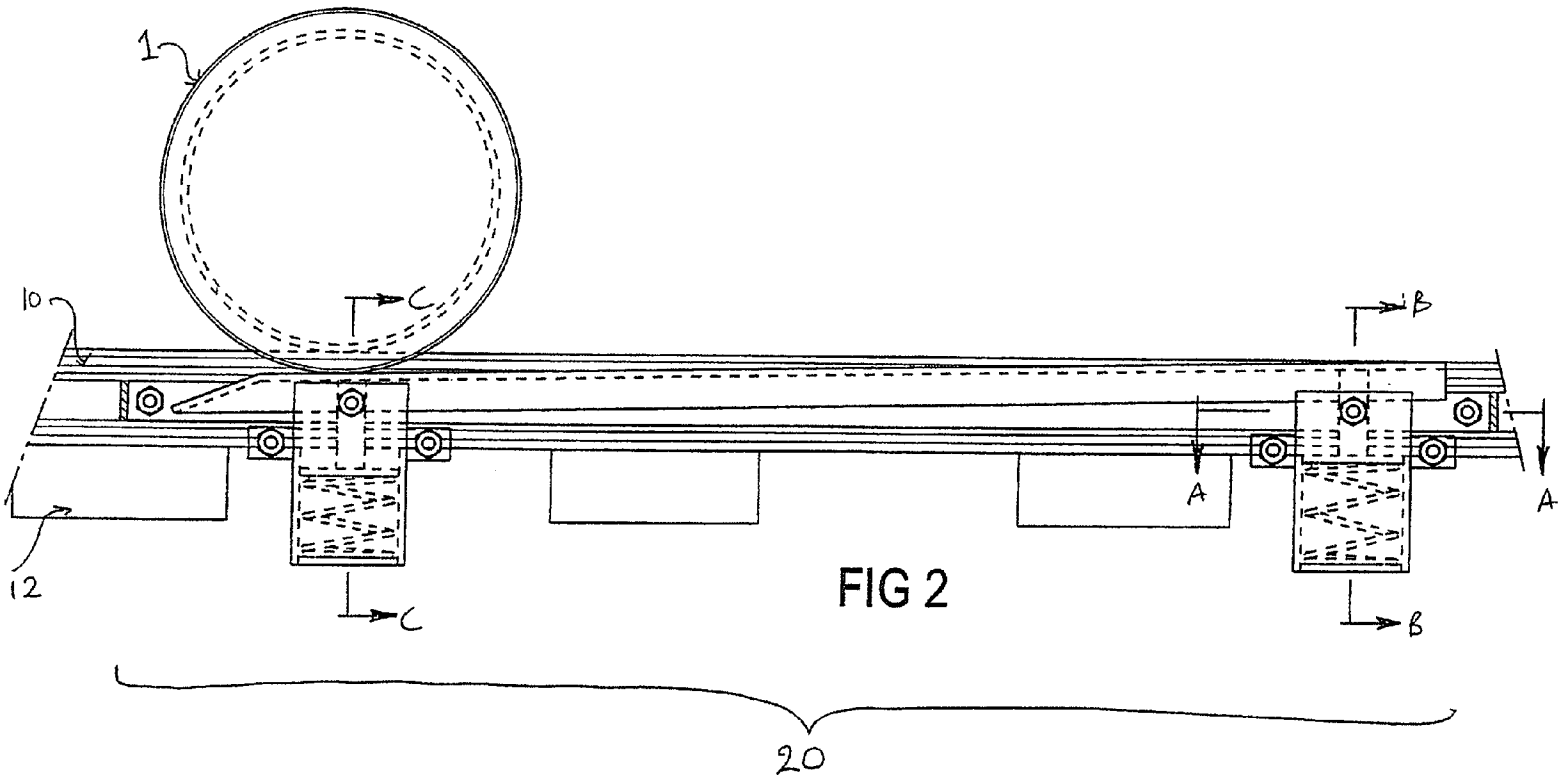
FIG. 2 is a side view of a preferred embodiment of the bridging platform arrangement of the present invention.
Figure 3:
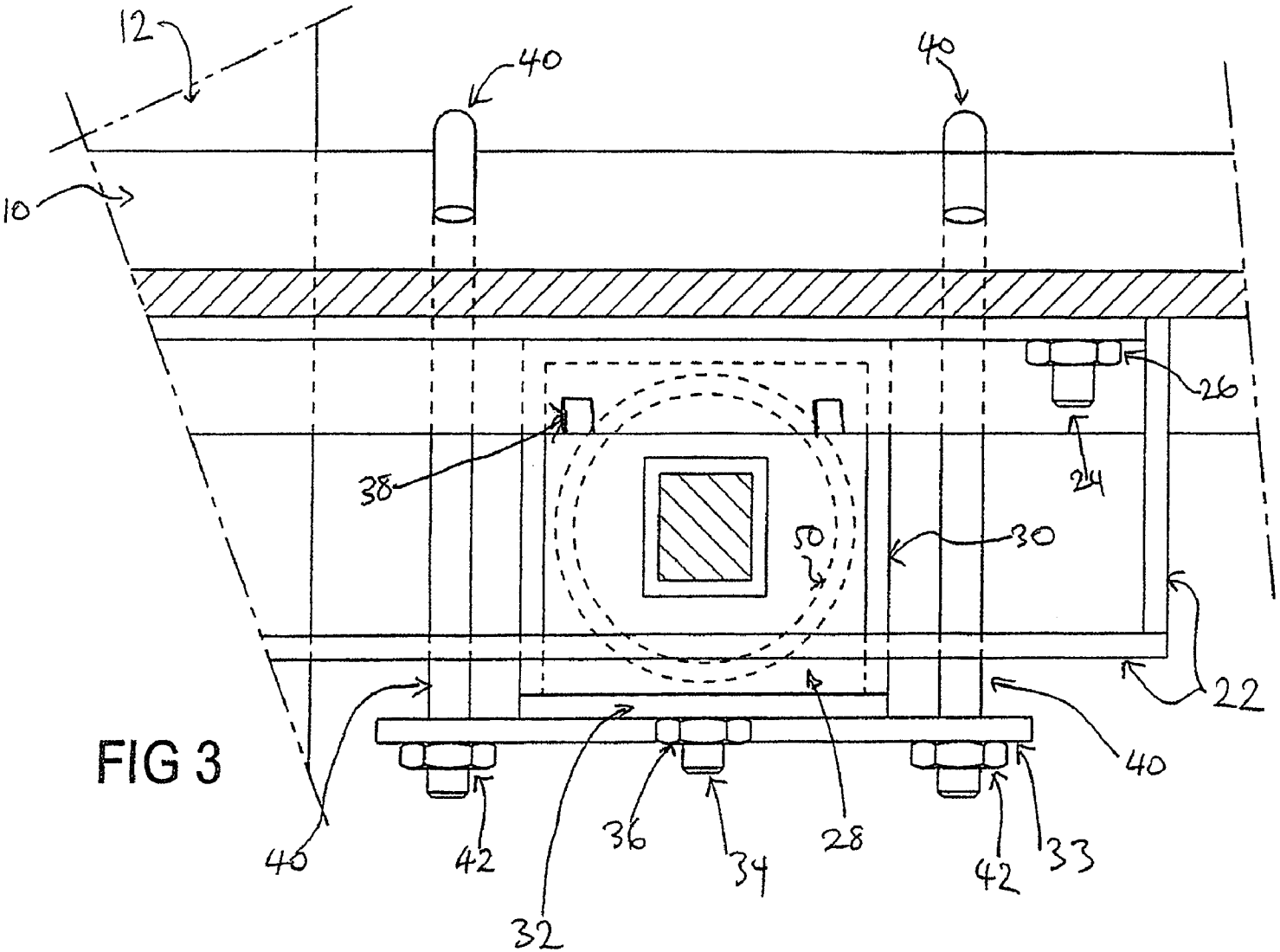
FIG. 3 is a top view of the preferred embodiment of the bridging platform arrangement of the present invention through Section A—A.

FIG. 2 shows a side view of the preferred embodiment installed adjacent a railway line. The bridging platform arrangement 20 is shown with some of its internal components visible is dotted outline. FIG. 3 is a sectional view of bridging platform arrangement 20. Guard frame 22 is connected through the web of railway rail 10 by piercing a hole through the web and inserting bolts 24 secured by nuts 26 (shown better in FIG. 3). The mounting arrangement includes a housing 30 in the shape of a box having an extending flange 32 for connecting the guard frame 22 to the housing 30. A spacer 28 is included between the flange 32 and guard frame 22 to position the guard frame 22 relative to the housing 30. Spacer 28 secures the guard frame 22 to flange 32 via a connecting bolt 34 and nut 36. The width of spacer of 28 can be adjusted to compensate for different sized gauges of railway wheel and also different sized bridging plate 58 (as will be discussed below). In this manner the guard frame is secured to the railway Housing 30 is secured to railway rail 10 via a clamping mechanism using lugs 38 and bolts 40 to clamp around the sides of the bottom of railway rail 10. Lugs 38 secure the side of the bottom of railway rail 10 that is closest to the housing 30, while bolts 40 are curved to form a "J" shape to secure around the side of railway rail 10 furthest from the housing 30. Bolts 40 are positioned through neck tie 33 and secured by nuts 42. Neck tie 33 is a elongate plate that can be secured to housing 30/flange 32 by welding or alternatively, by friction. By tightening nuts 42, the lugs 38 and J portion of the bolt 40 tighten around the bottom of railway rail 10. Bolt 40 is also kinked or bent, and the purpose of the kinked/bent arrangement in bolt 40, is to provide an upwards pull force to the bottom of the railway rail 10 to overcome the downward force of the plate 58 during operation (as will be discussed later). This can be explained better in FIGS. 4 and 5 which show the internal workings of the bridging platform arrangement 20.

The bridging platform arrangement 20 includes a housing 30 which is a closed rectanguloid having a base 44, sidewalls 46, and a top 48. Spring 50 is inserted inside housing 30 and is preloaded ie compressed. This spring is compressed to a load of 190 kilograms. A transfer plate 52 is inserted between the spring 50 and the top 48. Top 48 has an opening 54 which permits piston 56 to be connected to transfer plate 52 through opening 54. A bridging plate 58 is to be connected to piston 56 and is sized to fit within the footprint of frame 22 which essentially surrounds the sides of bridging plate 58. The bridging plate 58 is elongate and substantially planar, and preferably formed from a box or C-section shape. In this embodiment, it is approximately 75 mm suitable for use with a standard Australian gauge railway rail. Bridging plate 58 also includes a lip 60 which in this preferred embodiment is formed by attaching a plate to the underside of bridging plate 58 between the top of piston 56. Lip 60 extends beyond the bridging plate 58 towards the web of the railway rail 10 so that it is positioned in use underneath the head of railway rail 10. This serves to provide alignment for the bridging plate 58 as it moves between the first and second positions, and prevents bridging plate 58 from getting caught under the head of railway rail 10 and not returning to the first position.

Once secured to the railway rail 10, the pavement material can be cast so that the pavement 14 is flush with the top of the guard frame 22, the bridging plate 58 and the adjacent railway rail 10.

Figure 4:
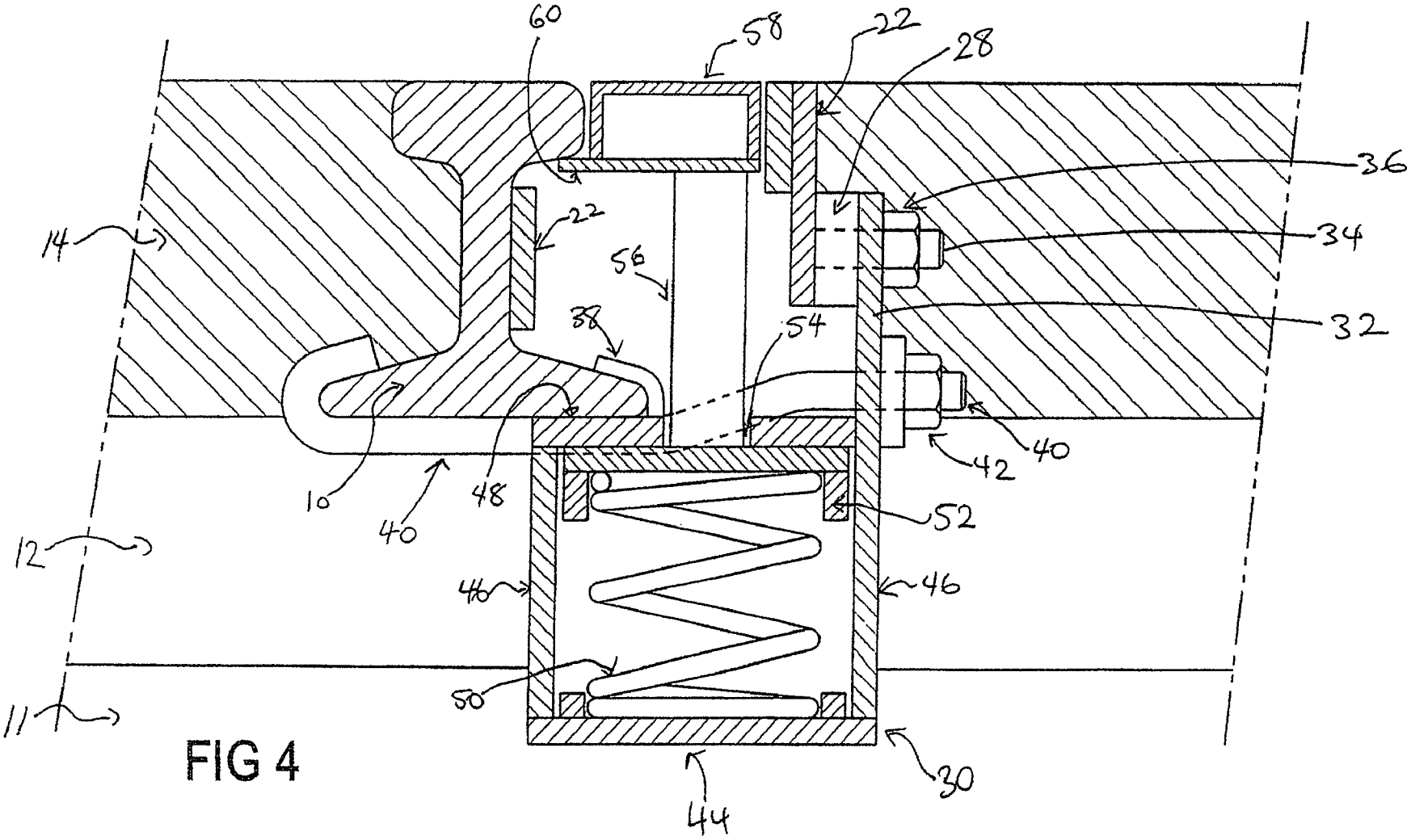
FIG. 4 is a front view of the preferred embodiment of the bridging platform arrangement of the present invention through Section B—B.

In FIG. 4, the bridging platform arrangement 20 is shown in the first position, where the compressed spring 50 ensures that when loads substantially less than that of a railway wheel 1 pass over the bridging platform arrangement 20, the piston 56 will not be lowered into the housing 30 and the bridging plate 58 is substantially maintained in the first position as shown.

Figure 5:
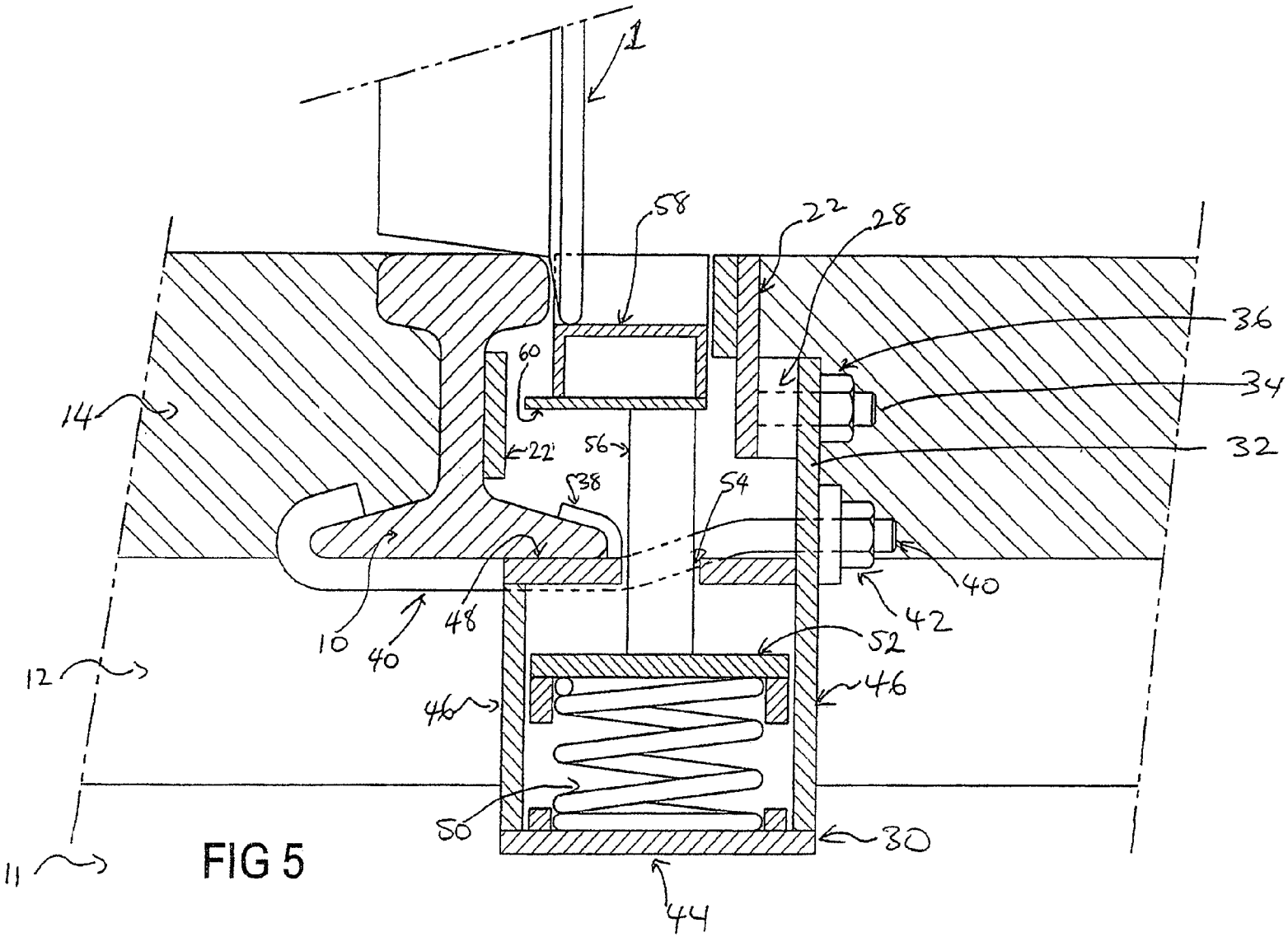
FIG. 5 is a front view of the preferred embodiment of the bridging platform arrangement of the present invention through Section C—C.

In FIG. 5, the bridging platform arrangement 20 is shown in the second position, where the load of the railway wheel 1 over the bridging plate 58 is transferred via the piston 56 and transfer plate 52 and piston 56 will be lowered into the housing 30 and the spring 50 is compressed further due to the additional load. In this manner, railway wheel 1 is able to travel along railway rail 10. For an Australian gauge railway rail, the second position is displaced between 40 to 45 mm lower than the first position.

In operation, at rest, the platform bridging arrangement 20 maintains the plate 58 at a level adjacent the upper surface of the railway rail 10 and the pavement 14 (i.e. the first position). When a pedestrian, or a wheelchair or a bike rolls over plate 58, the weight force is substantially less than that of the engagement of a wheel of a railway vehicle, and insufficient to counteract that of spring 50, so that plate 58 maintains a position substantially level with the pavement 14 and top of the railway rail 10. However, as seen in FIG. 5, when a railway wheel strikes the top surface of plate 58, the railway wheel 1 applies a load onto plate 58 forcing piston 56 downwards into the housing 30, whereupon spring 50 is compressed further. In this arrangement, the railway wheel is able to pass over the bridging platform arrangement 20, and the bridging platform arrangement 20 permits the displacement of the plate 58 into the second position. When the railway wheel 1 continues over the plate 58, the next location of the piston 56 and housing 30 can be compressed and so on depending on how many mounting arrangements are associated with each bridging plate 58 in each bridging platform arrangement 20. As is shown in FIG. 2, the preferred embodiment includes two mounting arrangements that are positioned between sleepers 12. More than one mounting arrangement can be associated with each bridging plate 58 in each bridging platform arrangement 20.

In addition, more than one bridging platform arrangement 20 can be linked together also. A joining finger (not shown) can provide a linking means between adjacent plates 58 of adjacent bridging platform arrangements 20. Alternatively a slot in each plate 58 and a linking pin could be used (not shown).

Figure 6:
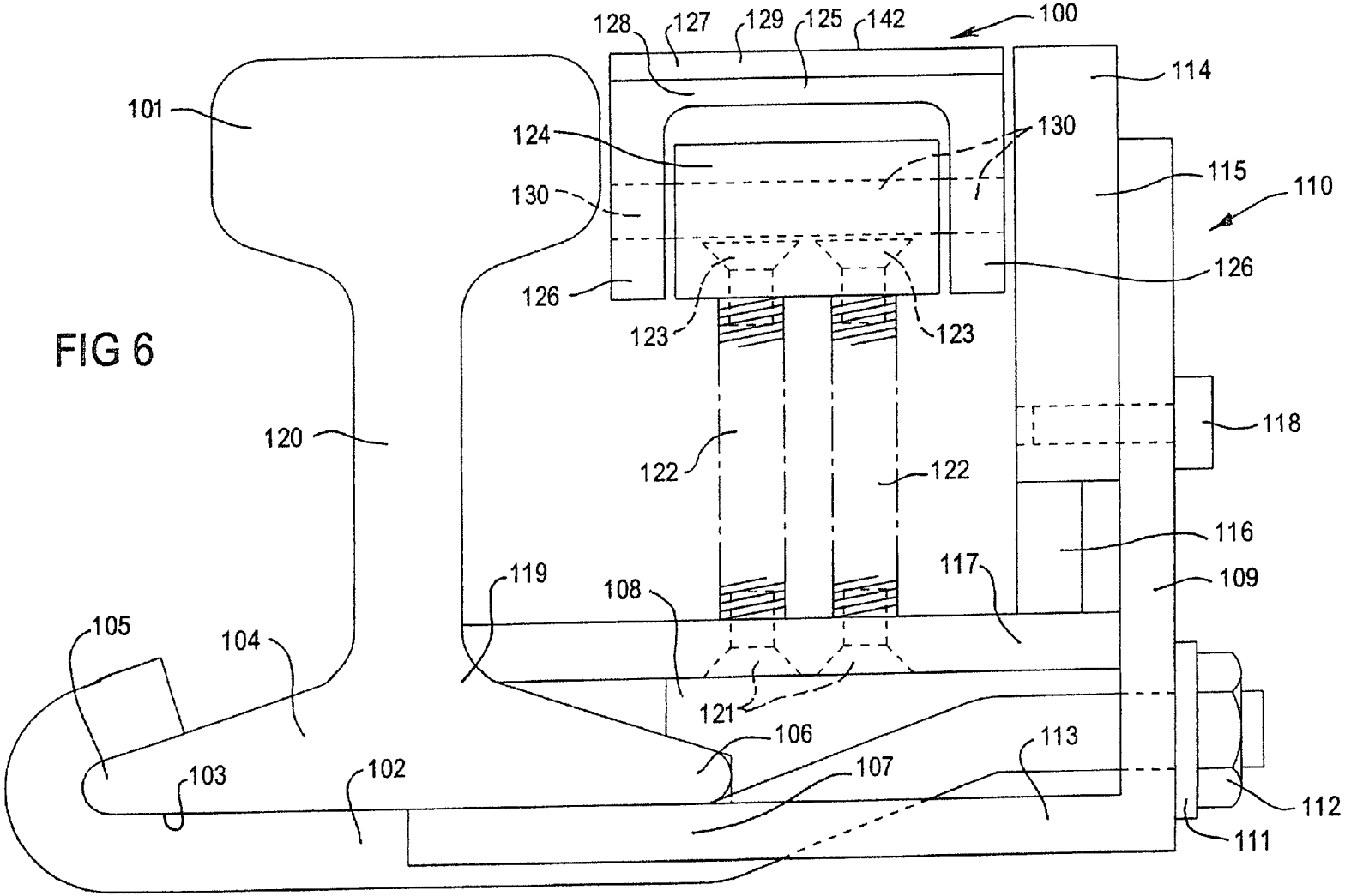
FIG. 6 is a sectional view of an alternative embodiment of a bridging platform arrangement according to the present invention.
Figure 7:
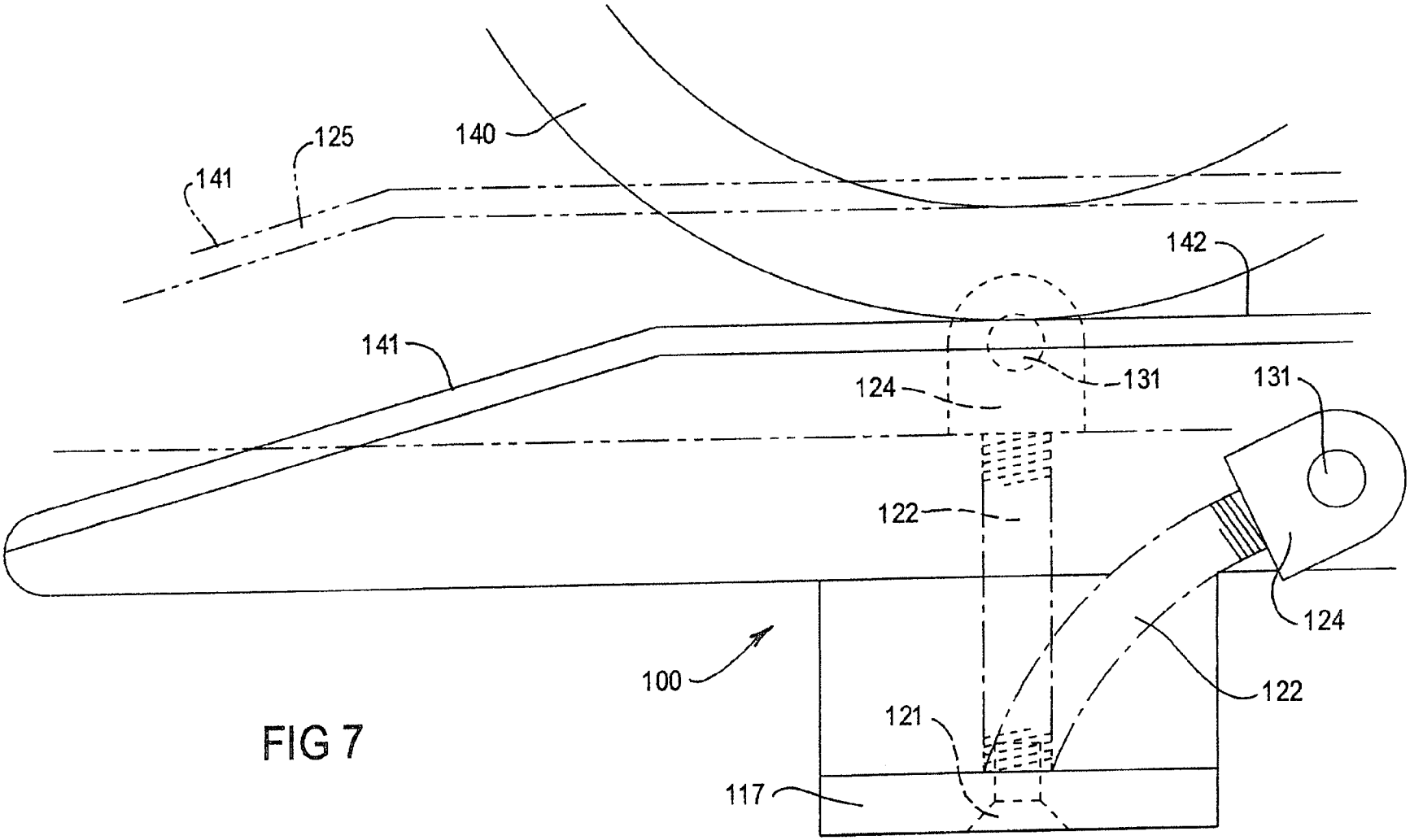
FIG. 7 is a side view of the bridging platform arrangement of FIG. 6.

FIGS. 6 and 7 illustrate a second embodiment of a bridging platform arrangement 100 according to the invention. Referring to FIG. 6, a railway rail 101 is shown and the rail 101 is fixed in place in the same manner as the rail 10 of the earlier figures. Thus, the rail 101 is supported on a series of spaced apart sleepers (not shown) and connected to the sleepers by suitable connection pins (also not shown). A profiled bolt 102 extends from one side of the rail 101, along the base 103 of a bottom flange 104 of the rail 101 and about the outer lateral edge 105 of the flange 104. As shown, the bolt 102 accommodates the lateral edge 105, while the opposite lateral edge 106 is accommodated between an inboard section 107 of the bolt 102 and a locating member 108. The bolt 102 extends to a side wall 109 of a housing 110 and is fixed in place by a washer 111 and a nut 112. This arrangement fixes the housing relative to the railway rail 101.

The housing 110 includes a base plate 113 which extends perpendicular to the side wall 109. The base plate 113 underlies the base 103 of the rail 101.

Bolted to the side wall 109, is a frame assembly 114 which comprises a first upper member 115, a second lower member 116 and a mounting plate 117. Of this assembly 114, the upper member 115 is bolted by the bolt 118 to the side wall 109, while the lower member 116 is welded to each of the upper member 115 and the mounting plate 117. The mounting plate 117 extends to the junction 119 between the bottom flange 104 of the rail 101 and the web 120. The mounting plate 117 can rest in abutment at the junction 119, or it can be fixed in place as required.

Fixed to the mounting plate 117 is a pair of fixing members 121 that are threaded into suitable spaced apart openings in the mounting plate 117 and which are used to secure respective bottom ends of coil springs 122. The bottom ends of the coil springs are fixed to the fixing members 121 by threaded engagement with the fixing members 121. That is, the fixing members 121 include a thread which is matched to the windings of the coil springs so that a threaded engagement can be made.

Likewise at the upper ends of the coil springs 122, further fixing members 123 are threadably engaged within a head member 124 which are used to secure respective upper ends of the coil springs 122. The head member 124 preferably is of a molded plastic and the fixing members 123 are embedded within the head member 124. Each fixing member 123 may be welded to a plate which is also embedded within the head member 124, to prevent the fixing members 123 from rotating. The head member 124 is accommodated within a C-section bridging plate 125, which comprises side flanges 126 and a bridging member 127. The bridging member 127 comprises a first metal component 128 which is formed integrally with the side flanges 126 and a surface layer 129 which preferably is a polyurethane layer.

The head member 124 is secured relative to the bridging plate 125 by a pin (not shown) which extends through aligned openings 130 formed through the head member 124 and the side flanges 126 and shown in broken outline. As will become apparent hereinafter, the pin facilitates relative rotation between the head member 124 and the bridging plate 125.

The arrangement of the coil springs 122 is repeated through the length of the bridging plate 125 and in a bridging plate having a length of about three metres, four or five coil spring stations would be provided.

In the FIG. 6 embodiment, the coil springs 122 are shown extending vertically. In this orientation, the spring coils are tightly compacted principally under the load of the bridging plate 125 and the coil springs 122 therefore form a vertical column. As a column, each coil spring 122 can support a substantial load which acts in a downward direction. However, the coil springs 122 can be arranged to deflect in the lengthwise direction of the bridging plate 125 and to explain that movement, reference will now be made to FIG. 7.

In FIG. 7, a portion of the arrangement 100 of FIG. 6 is illustrated along with a railway wheel 140. The bridging plate 125 is also shown in side view and this is seen in two positions, differentiated by broken and solid outlines. The broken outline represents the bridging plate 125 in the upright or rest position shown in FIG. 6. In this position, the coil spring 122 is shown extending vertically to the head member 124. The pin 130 is also shown in connection between the head member 124 and the bridging plate 125.

When a railway vehicle approaches the bridging platform arrangement 100, in the direction shown in FIG. 7, i.e. with the railway wheel 140 rotating clockwise, the wheel 140 engages the bridging plate 125 over the ramp section 141 which is an inclined surface of the bridging plate 125. Only one end of the bridging plate 125 is shown in FIG. 7, but the other end of the bridging plate 125 would also include a ramp section 141. The direction of engagement of the railway wheel 140 with the bridging plate 125 along with the weight of the railway vehicle supported by the wheel 140 causes the coil spring 122 to buckle or deflect in the manner shown in solid outline so that the coil spring 122 bends in a clockwise direction and by this movement, there is relative rotation between the head member 124 and the bridging plate 125 about the pin 131 and the effect as shown in FIG. 7 is that the bridging plate 125 is lowered in an arcuate movement. In trials, it has been shown that the bridging plate 125 is lowered so that its upper surface 142 remains substantially horizontal. It is conceivable however, that the bridging plate 125 would be lowered successively from the end of first engagement of the bridging plate 125 to the other end in the direction of wheel travel over it, so that the upper surface 142 would have a wave-like motion, as the wheel 140 moves over it.

Advantageously, upon the wheel 140 fully traversing the length of the bridging plate 125, the bridging plate 125 will be returned to the rest position shown in broken outline in FIG. 7 and in solid outline in FIG. 6, by the coil springs 122 recovering from their deflected position. Thus, there is automatic return of the bridging plate 125 from the lowered position.

Further advantageously, the arrangement of FIG. 6 is operable in either direction of railway wheel movement over it. Thus, the direction of deflection of the coil springs 122 in FIG. 7 can easily occur in the opposite direction so that anti-clockwise deflection of the coil springs 122 takes place, without necessitating a change in the configuration of the bridging platform arrangement 100.

The arrangement shown in FIGS. 6 and 7 is extremely durable as the coil springs 122 can be arranged to have a substantial life without failure, and therefore the maintenance requirements of the bridging platform arrangement 100 relate principally to replacement of the surface layer 129 of the bridging plate 125 from time-to-time. It will readily be appreciated, that the selection of surface layer 129 will principally dictate the period between replacement or maintenance of the bridging platform arrangement 100.

Various sizes and components of the platform can be modified according to the railway rail sizes and pavement widths that require a bridging platform including various configurations where railway tracks diverge or cross each other, and these other preferred embodiments are foreshadowed. For example, a larger gauge railway rail has a greater height and width cross-section of the railway rail. This means that the height of the piston 56, the location of the bridging plate 58, the height of flange 32, spacer 28, length of bolts 40, are just some examples of the changes required to modify the bridging platform arrangement 20 that need to be changed.

Finally, it is to be understood that various alterations, modifications and/or additions may be introduced into the platform previously described without departing from the spirit or ambit of the invention as defined in the claims herein.

What is claimed is:

1. A bridging platform arrangement for bridging a gap between a railway rail and an adjacent ground surface comprising:

a substantially rigid, elongate bridging plate which extends in use generally parallel to the railway rail and which has a generally planar upper surface extending between opposite sides of said bridging plate;

a mounting arrangement for mounting said bridging plate between said railway rail and said ground surface;

wherein in use, said mounting arrangement permits displacement of said bridging plate between:

a first rest position in which said upper surface of said bridging plate extends between respective upper surfaces of said railway rail and said ground surface; and a second displaced position in which said bridging plate is displaced so that said upper surface, between said opposite sides, is displaced below said first position, so that said plate does not interfere with the passage along said railway rail of a wheel of a railway vehicle;

said mounting arrangement being operable to permit displacement of said bridging plate from said first position to said second position under a railway vehicle load imposed on said bridging plate by engagement of said bridging plate by the wheel of a railway vehicle, and to substantially maintain said first position when said bridging plate is engaged by a load substantially less than that of said railway vehicle load;

wherein said mounting arrangement includes a biasing means for permitting displacement of the bridging plate between said first and second positions and at least one piston connected to the biasing means at a first end, and to the bridging plate at the second end.

2. An arrangement as claimed in claim 1 wherein said biasing means biases said bridging plate towards said first position.

3. An arrangement as claimed in claim 1 wherein said biasing means is a coil spring.

4. An arrangement as claimed in claim 1 wherein the mounting arrangement includes a housing for housing the biasing means, wherein the housing includes a base and a top, and sidewalls extending therebetween, the biasing means located inside the housing, and said top including an opening through which said piston extends for connection with the biasing means.

5. An arrangement as claimed in claim 4 wherein the mounting arrangement includes a transfer plate movably positioned inside said housing for movement with said biasing means between said biasing means and said top of said housing, said piston being connected to said biasing means by connection to said transfer plate.

6. An arrangement as claimed in claim 4 wherein the mounting arrangement includes securing means for securing the mounting arrangement to said railway rail.

7. An arrangement as claimed in claim 6 wherein the securing means includes a first connection element in connection with said housing, said first connection element being secured to a first side of the base of the railway rail adjacent the housing, and a second connection element in connection with said housing, said second connection element being secured to a second side of the base of the railway rail remote from the housing, the arrangement being such that by tightening of said second connection element relative to said housing, the housing is secured to said railway rail.

8. An arrangement as claimed in claim 4 wherein said housing is positioned between adjacent sleepers that support the railway rail.

9. An arrangement as claimed in claim 1 including at least two said mounting arrangements spaced along the length of said bridging plate.

10. An arrangement as claimed in claim 1 wherein the bridging plate of a first bridging platform arrangement includes linking means for connection to the linking means of a second bridging platform arrangement, so as to link the two arrangements together.

11. An arrangement as claimed in claim 10 wherein said linking means includes a slot formed in the bridging plate, so that a coupling pin can link a first bridging platform arrangement with a second bridging platform arrangement.

12. A bridging platform arrangement for bridging a gap between a railway rail and an adjacent ground surface comprising:

a substantially rigid, elongate bridging plate which extends in use generally parallel to the railway rail and which has a generally planar upper surface extending between opposite sides of said bridging plate;

a mounting arrangement for mounting said bridging plate between said railway rail and said ground surface;

wherein in use, said mounting arrangement permits displacement of said bridging plate between:

a first rest position in which said upper surface of said bridging plate extends between respective upper surfaces of said railway rail and said ground surface; and a second displaced position in which said bridging plate is displaced so that said upper surface, between said opposite sides, is displaced below said first position, so that said plate does not interfere with the passage alone said railway rail of a wheel of a railway vehicle;

said mounting arrangement being operable to permit displacement of said bridging plate from said first position to said second position under a railway vehicle load imposed on said bridging plate by engagement of said bridging plate by the wheel of a railway vehicle, and to substantially maintain said first position when said bridging plate is engaged by a load substantially less than that of said railway vehicle load, wherein said mounting arrangement includes at least two coil springs spaced apart between opposite ends of said bridging plate and which are fixed in place at bottom ends thereof, said coil springs extending substantially vertically when said bridging platform is in said first position, and being deflectable in the direction of movement of the wheel of a railway vehicle along said bridging plate to allow displacement of said bridging plate to a bent position away from substantially vertical, to allow arcuate displacement of said bridging plate from said first position to said second position, wherein said coil springs return from a deflected position following removal of said railway vehicle load to return said bridging plate to said rest position.

13. A bridging platform arrangement according to claim 12, wherein helical coils of said springs are in contact with each other when said coil springs are substantially vertical so that said coil springs act as a column to support vertical loads.

14. A bridging platform arrangement according to claim 12, wherein said deflection is initiated by engagement of the wheel of a railway vehicle with one end of said bridging plate.

15. A bridging platform arrangement according to claim 12, wherein at least two pairs of adjacent coil springs are spaced apart between said opposite ends of said bridging plate, said adjacent coil springs of said at least two pairs being further spaced apart generally laterally to a line extending between said opposite ends.

16. A bridging platform arrangement for bridging a gap between a railway rail and an adjacent ground surface comprising:

a substantially rigid, elongate bridging plate which extends in use generally parallel to the railway rail and which has a generally planar upper surface extending between opposite sides of said bridging plate;

a mounting arrangement for mounting said bridging plate between said railway rail and said ground surface;

wherein in use, said mounting arrangement permits displacement of said bridging plate between:

a first rest position in which said upper surface of said bridging plate extends between respective upper surfaces of said railway rail and said ground surface; and a second displaced position in which said bridging plate is displaced so that said upper surface, between said opposite sides, is displaced below said first position, so that said plate does not interfere with the passage along said railway rail of a wheel of a railway vehicle;

said mounting arrangement being operable to permit displacement of said bridging plate from said first position to said second position under a railway vehicle load imposed on said bridging plate by engagement of said bridging plate by the wheel of a railway vehicle, and to substantially maintain said first position when said bridging plate is engaged by a load substantially less than that of said railway vehicle load;

wherein said mounting arrangement includes at least two deflectable members spaced apart between opposite ends of said bridging plate, said deflectable members being deflectable in the direction of movement of the wheel of a railway vehicle along said bridging plate to allow displacement of said bridging plate from said first position to said second position, wherein said deflectable members return from a deflected position following complete travel of said wheel along said bridging plate to return said bridging plate to said rest position; and, wherein said bridging plate comprises an elongate C-section defining a centre web and a pair of parallel flanges extending downwardly from said web, and a connection member disposed between said flanges and connected to said flanges for rotation relative to said C-section, each said deflectable member being connected to a said connection member and said relative rotation occurring during displacement of said bridging plate between said first and second positions.

17. A bridging platform arrangement according to claim 16, wherein said connection member is connected to said C-section by a pin which extends through said connection member and through said flanges.

18. A bridging platform arrangement for bridging a gap between a railway rail and an adjacent ground surface comprising:

a substantially rigid, elongate bridging plate which extends in use generally parallel to the railway rail and which has a generally planar upper surface extending between opposite sides of said bridging plate;

a mounting arrangement for mounting said bridging plate between said railway rail and said ground surface;

wherein in use, said mounting arrangement permits displacement of said bridging plate between:

a first rest position in which said upper surface of said bridging plate extends between respective upper surfaces of said railway rail and said ground surface; and a second displaced position in which said bridging plate is displaced so that said upper surface, between said opposite sides, is displaced below said first position, so that said plate does not interfere with the passage along said railway rail of a wheel of a railway vehicle;

said bridging plate from said first position to said second position under a railway vehicle load imposed on said bridging plate by engagement of said bridging plate by the wheel of a railway vehicle, and to substantially maintain said first position when said bridging plate is engaged by a load substantially less than that of said railway vehicle load wherein said mounting arrangement includes at least two pairs of coil springs spaced apart between opposite ends of said bridging plate, said coil springs extending substantially vertically when said bridging platform is in said first position and being deflectable in the direction of movement of the wheel of a railway vehicle along said bridging plate to a bent position away from substantially vertical, to allow arcuate displacement of said bridging plate from said first position to said second position, wherein said coil springs return from a deflected position following complete travel of said wheel along said bridging plate to return said bridging plate to said rest position, wherein the helical coils of said springs are in contact with each other when said coil springs are substantially vertical so that said coil springs act as a column to support vertical loads.

* * * * *